US007076878B2

(12) United States Patent
Degregorio, Jr.

(10) Patent No.: US 7,076,878 B2
(45) **Date of Patent: *Jul. 18, 2006**

(54) BEARD TRIMMER WITH INTERNAL VACUUM

(76) Inventor: Dennis P. Degregorio, Jr., 15736 Terrace Dr., Oak Forest, IL (US) 60452

( * ) Notice: Subject to any disclaimer, the term of this patent is extended or adjusted under 35 U.S.C. 154(b) by 138 days.

This patent is subject to a terminal disclaimer.

(21) Appl. No.: 10/901,541

(22) Filed: Jul. 29, 2004

(65) Prior Publication Data

US 2005/0060889 A1 Mar. 24, 2005

Related U.S. Application Data

(63) Continuation of application No. 10/075,647, filed on Feb. 14, 2002.

(60) Provisional application No. 60/268,732, filed on Feb. 14, 2001.

(51) Int. Cl.
*B26B 19/44* (2006.01)

(52) U.S. Cl. ..... 30/133; 30/41.6

(58) Field of Classification Search ..... 30/41.5, 30/41.6, 133

See application file for complete search history.

(56) References Cited

U.S. PATENT DOCUMENTS

| | | | |
|---|---|---|---|
| 1,572,644 | A | 2/1926 | Farnsworth |
| 5,075,971 | A | 12/1991 | McCambridge |
| 5,261,161 | A | 11/1993 | Lee |
| 5,724,736 | A | 3/1998 | Smith |
| 2002/0073549 | A1 | 6/2002 | McCambridge et al. |

*Primary Examiner*—Douglas D Watts
(74) *Attorney, Agent, or Firm*—Barnes & Thornburg LLP; David C. Brezina; Mark J. Nahnsen

(57) ABSTRACT

The invention is directed to a beard trimmer with an internal vacuum system that collects the hair clippings generated by the trimmer during grooming. The beard trimmer is comprised of two main mechanisms, a beard trimmer and a vacuum powered suction unit. The beard trimmer with internal vacuum is comprised of an external body, which houses a motor, wiring, and a power source. Additionally, the beard trimmer casing also houses the vacuum powered suction unit. The beard trimmer also includes of a pair of reciprocating cutting blades and an electric motor that drives the blades. The vacuum powered suction unit includes an air intake, a filter unit, a hamster cage or turbine style impeller, a filter unit housing, and at least one external exhaust port. The suction unit is designed to capture the clippings created by the blades during grooming. The resultant trimmer allows an operator to trim facial hair while simultaneously collecting hair clippings created by the trimming process.

20 Claims, 4 Drawing Sheets

BEARD TRIMMER WITH INTERNAL VACUUM

This application is a continuation of U.S. patent application Ser. No. 10/075,647 filed Feb. 14, 2002, which claims priority from Provisional Application No. 60/268,732 filed on Feb. 14, 2001.

BACKGROUND OF THE INVENTION

This invention may be described as an improved beard trimmer with an internal vacuum, which collects hairs as they are cut by the blade, significantly reducing the amount of clean up that is involved after grooming.

DESCRIPTION OF RELATED ART

Beard trimmers are used by millions of men for grooming. Beard trimmers are well known in the art, but suffer from the same drawback. Due to the high velocity of the blades, the beard trimmers leave hair clippings around the sink, which are difficult to clean up. By incorporating an internal integrated vacuum system, the hairless beard trimmer collects and contains the cut hairs as the beard is groomed to prevent hair clippings from covering the sink and surrounding area.

SUMMARY OF THE INVENTION

The present invention is directed to a beard trimmer with an internal vacuum system that catches and contains hair clippings generated by the trimmer during grooming. The beard trimmer is comprised of two main mechanisms, a beard trimmer and a vacuum powered suction unit. The beard trimmer with internal vacuum is comprised of an external body, which houses a motor, wiring and a power source. Additionally, the beard trimmer body also houses the vacuum powered suction unit. The vacuum powered suction unit includes an air intake, a filter unit, a cage or turbine style impeller, a filter unit housing, and at least one external port. The suction unit is designed to capture the clippings created by the blades during grooming. The air intake includes a tapered scoop designed so that it tapers into the body of the beard trimmer to funnel the hair clippings through the suction unit. The resultant trimmer allows an operator to trim facial hair while simultaneously collecting hair clippings created by the trimming process.

DETAILED DESCRIPTION OF THE INVENTION

While the present invention will be described fully hereinafter with reference to the accompanying drawings, in which a particular embodiment is shown, it is understood at the outset that persons skilled in the art may modify the invention herein described while still achieving the desired result of this invention. Accordingly, the description that follows is to be understood as a broad informative disclosure directed to persons skilled in the appropriate arts and not as limitations of the present invention.

Figure 2:
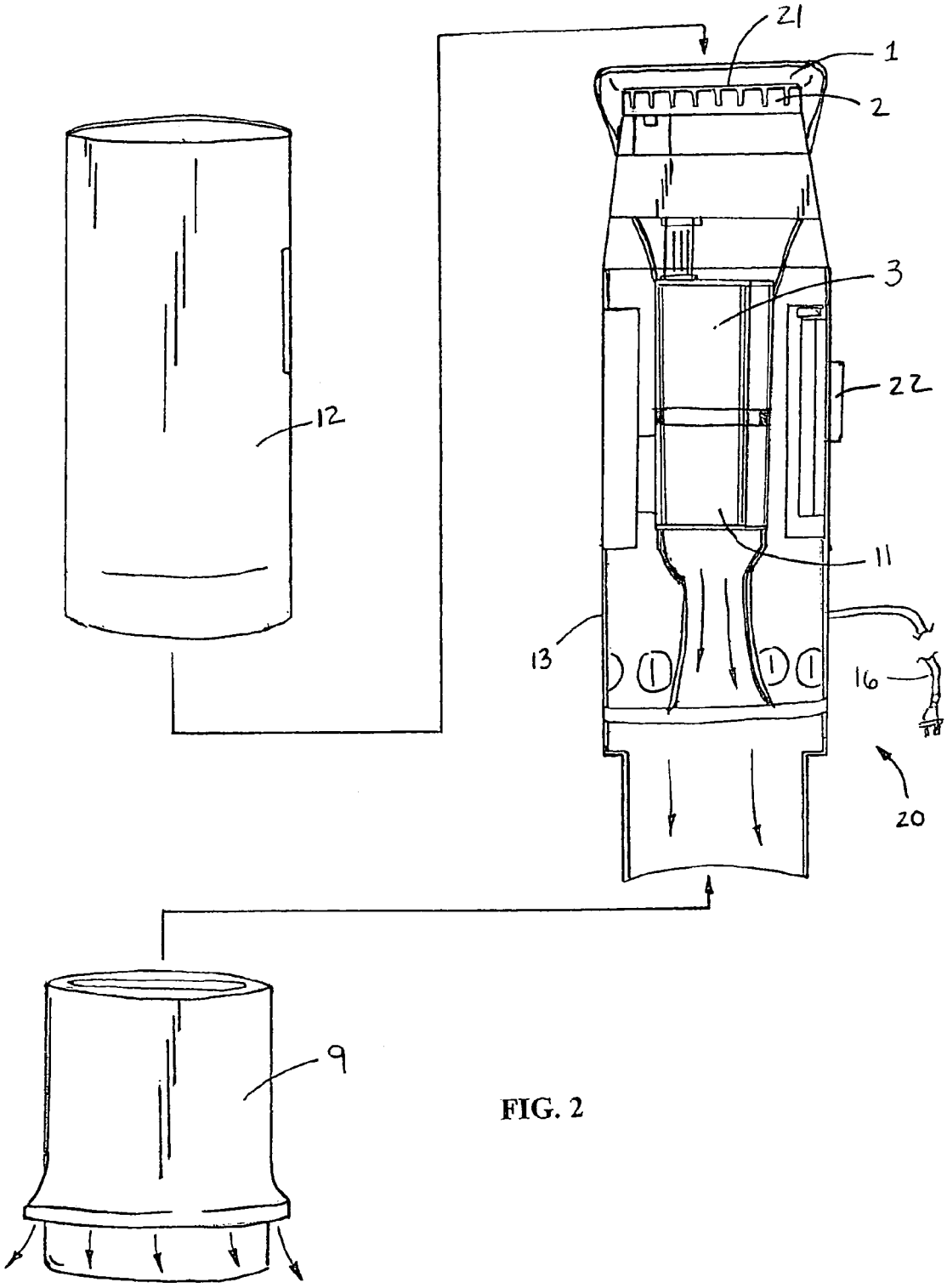
FIG. 2 is a sectional view of the vacuum powered suction unit in a second embodiment of the present invention.
Figure 5:
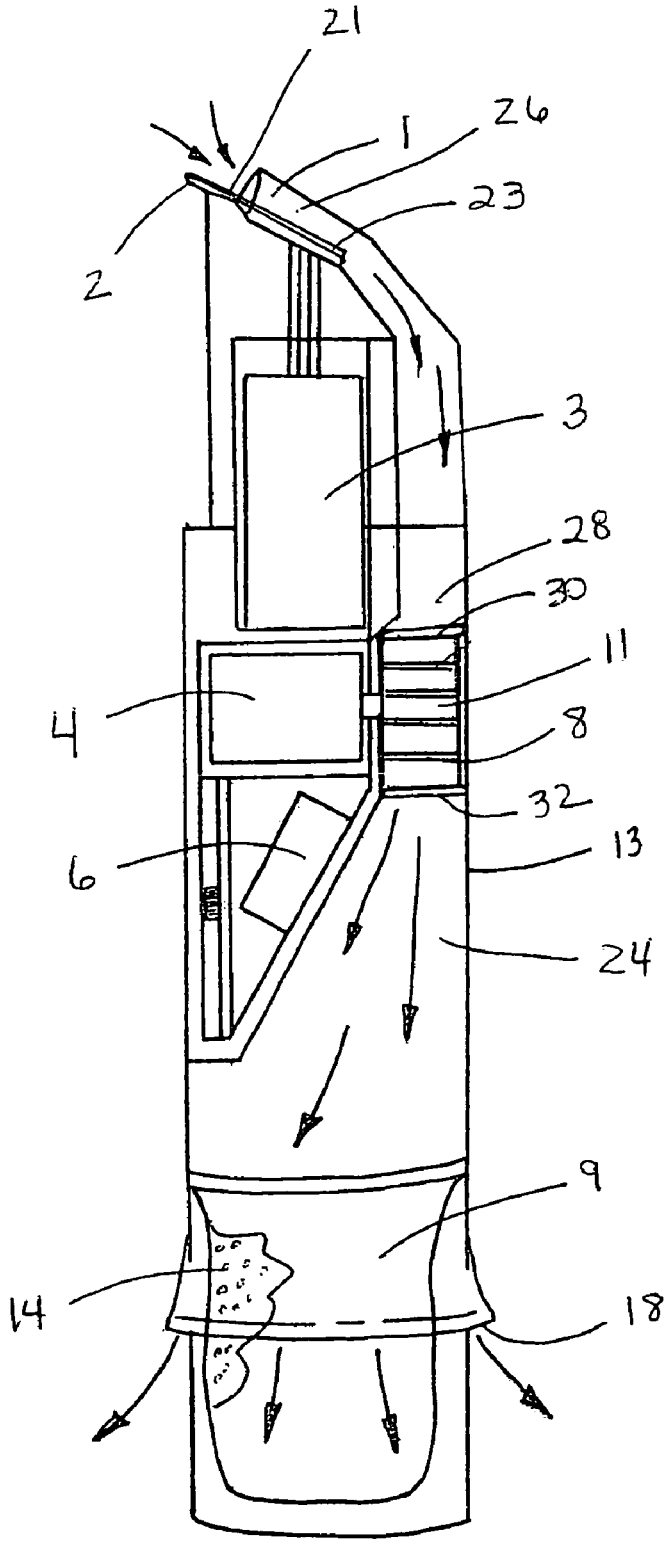
FIG. 5 is a rear view of the tapered rear of the vacuum scoop.

A beard trimmer 20 with internal vacuum 11 of the present invention is shown in FIGS. 2 and 5. The internal vacuum 11 is mounted in a beard trimmer body 13, which is vibration resistant, durable, and lightweight. The beard trimmer 20 with internal vacuum 11 allows the user unaided cleanup of hair clippings left behind from cutting blades 2 of the beard trimmer 20. The beard trimmer 20 includes the trimmer body 13, a filter bag housing 9 and a trimmer casing 12. The trimmer body 13 houses the power switch 22, an electric motor 3 for reciprocating cutting blades 2 and the internal vacuum unit 11, which creates an internal suction within the trimmer body 13. The trimmer 20 further includes passageways 24 to direct clippings from the vacuum unit 11 to the filter bag 9.

Figure 3:
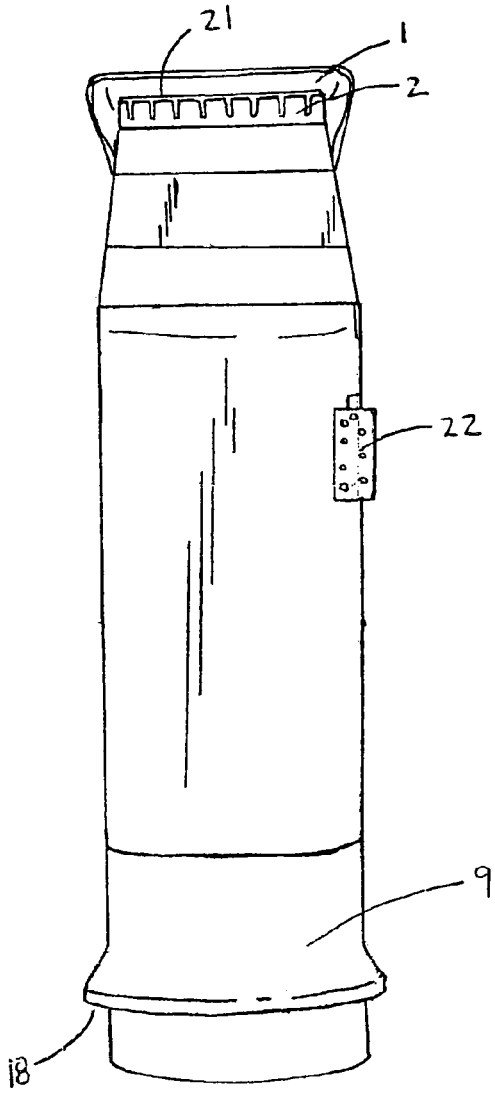
FIG. 3 is side perspective and partial sectional view of the beard trimmer.

The internal vacuum unit 11, shown in FIG. 3, is integrated into the beard trimmer body 13 and has a scooped air intake 1 on the outside the casing 12 adjacent to the trimmer blades 2. The internal vacuum unit shown in FIG. 5 has an air intake 1, at least one motor 3, a power supply 6, a cage or turbine style impeller 8, a filter bag housing 9, and at least one exhaust port 18.

The trimmer assembly 20 shown in FIG. 5 of the preferred embodiment, uses the metal blades 2 to cut the facial hair. The trimmer blades 2 are in sliding contact with one another and are arranged so that the blades 2 extend towards the front 21 of the beard trimmer 20. The rear of the trimmer blades 23 is connected to the motor 3 and is attached to the trimmer body 13 so as to provide support for the blades 2 while also allowing lateral movement for cutting. The trimmer blades 2 are powered by the motor 3, which moves the trimmer blades 2 laterally with respect to each other. This lateral movement allows the trimmer blades 2 to uniformly shear facial hair. Additionally, the trimmer blades 2 are slidably adjustable with respect to the beard trimmer 20 allowing for variations in cutting depth. Blade guards (not shown) may also be placed on the trimmer blades 2 to adjust the cutting depth. While this is the preferred blade assembly, one who is reasonably skilled in the art may foresee that a rotary blade assembly may be used, wherein the blades operate in a clockwise or counter-clockwise direction.

The motor 3 is mounted within the trimmer body 13 of the beard trimmer 20. The motor 3 operates the trimmer blades 2 and rotates the impeller to create the vacuum suction required to direct the facial hair into the air intake 1 of the beard trimmer with internal vacuum 11. The motor 3 can be either powered by an outside source, such as a wall outlet or may use an internal battery 6, as shown in FIG. 3. The motor 3 is adapted to operate the movement of the beard trimmer blades 2 and the internal vacuum 11. In the preferred embodiment, a second motor 4, shown in FIG. 5, drives the impeller 8, which is used to draw the hair clippings into the filter bag 9 as shown in FIG. 3. The impeller 8 produces the pressure differential required to create the suction necessary to adequately direct the hair clippings from the blades 2 into the intake 1. The impeller 8 directs the ambient air through passageway 24 and creates a negative pressure at the intake of the scoop 1. This arrangement directs the cut facial hair into the intake 1, through the passageway 24 to the filter bag 9. Air then passes through the filter bag 9 and out of the trimmer 20, leaving the hair behind.

The air intake 1 is mounted near of the cutting blades 2. This arrangement allows the clippings to be immediately directed into the air intake 1 upon cutting. The air intake 1 is of a ducted design that tapers into the beard trimmer body 13. The air intake 1 is preferably fabricated out of plastic, however, one skilled in the art could fabricate the air intake 1 out of other materials including metal alloys, resins, or any other material of sufficient strength. The air intake is comprised of the mouth section 26 and the rear section 28. The mouth section 26 of the air intake 1 is slightly wider and higher than the trimmer blades 2, as shown in FIGS. 2–5, so that it covers the full range of movement of the blades 2 to catch the hair clippings discharged by the trimmer blades 2. The rear section 28 of the air intake 1 funnels the low-pressure air and clippings into the impeller 8.

The impeller 8 preferably is made out of light-weight aluminum, although other materials can be used including metal, plastic, or other materials sufficient to function as an impeller 8. The impeller 8 is rectangular in shape and includes a top member 30 and a bottom member 32. The impeller 8 generates the suction required to capture the majority of the clippings created by the trimmer blades 2.

In a second embodiment, a single motor 3 would operate as the sole drive source for both the trimmer blades 2 and the internal vacuum unit shown in FIG. 2. The motor 3 receives its power from an outside electric current or an internal battery. The outside current is obtained via an outlet by using an electric cord 16 located at the rear of the beard trimmer 20.

Figure 1:
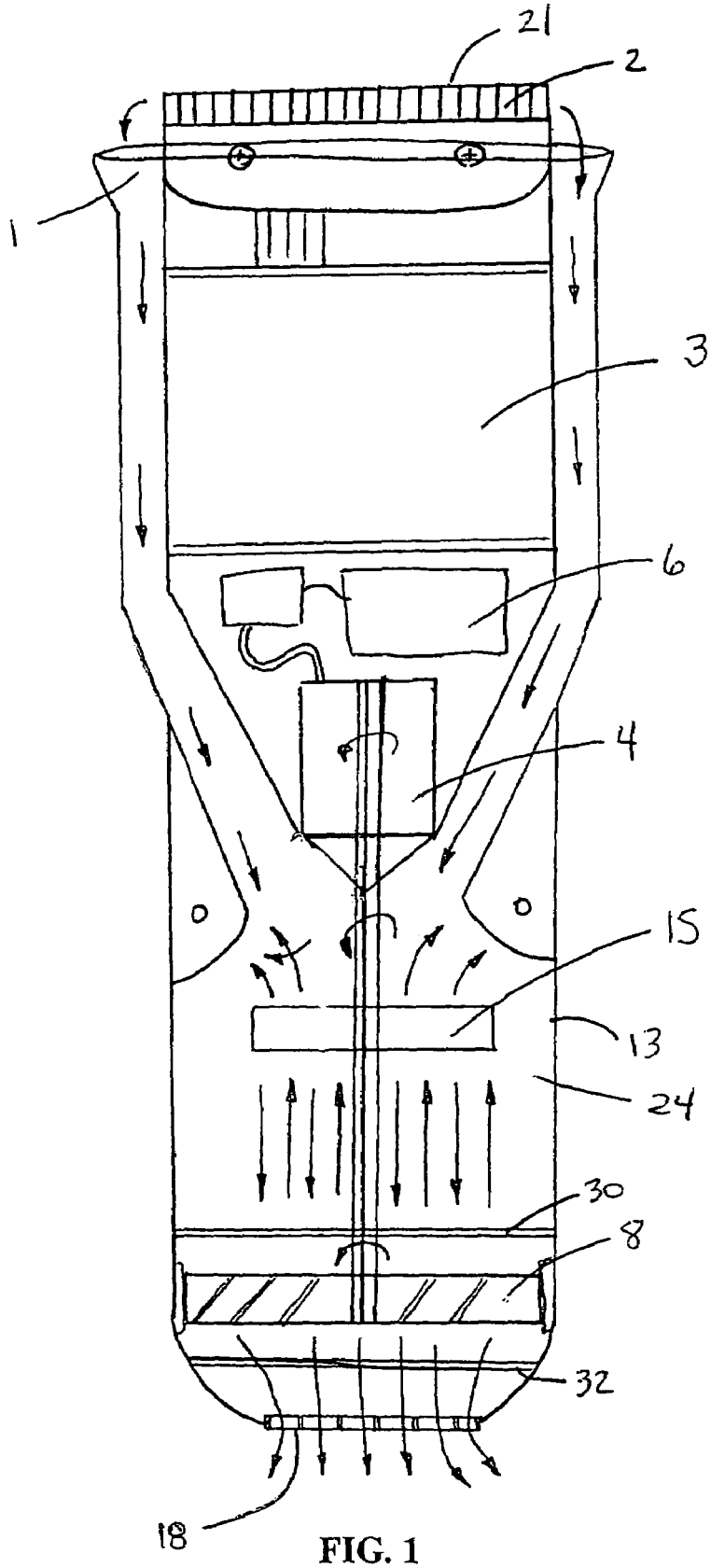
FIG. 1 is a sectional view of the vacuum powered suction unit of a first embodiment of the present invention.

The motor 4 rotates the impeller 8 to generate the suction force required to create a negative pressure zone to direct the clippings into the vacuum intake 1 as shown in a second embodiment in FIG. 1. The suction generated by the impeller 8 propels the hair clippings from the intake 1 into the top member 30 of the impeller 8. Once in the impeller 8, a high-pressure zone is created, which propels the hairs through the set of blades 15, that further reduces the size of the hair clippings. The hairs are then propelled through passageway 24 that directs the hair clippings into the filter bag housing 9.

The vacuum passageway 24 connects the impeller 8 to the filter bag housing 9. The passageway 24 is made of an erosion resistant material so that the coarse hair traveling through the passageway 24 do not erode the passageway 24. The filter bag 9 contains pores 14, shown in FIG. 5, which are large enough to allow for the passage of air but are small enough to prevent the hair clippings from escaping the trimmer 11. The pores 14 allow the pressurized air from vacuum passageway 24 to escape through the back of the unit.

The filter bag housing 9 is preferably cylindrical in design. In a first embodiment, the filter bag housing 9 would include a filter medium that is made of a woven, unwoven or other porous plastic material sufficient to filter the exhaust air passing out of the trimmer body 13. The filter bag housing 9 filter medium may also be made of paper fiber or other material that would allow for the passage of air and retain the cut particles. The filter bag housing 9 is removably attached to the trimmer body 13 by use of a pressure or threaded fitting, or by sliding.

Surrounding the filter bag housing 9 are the exhaust ports 18. The exhaust ports 18 allow the high-pressure air to escape to the atmosphere, thereby creating a pressure zone inside the housing 9 the beard trimmer with internal vacuum 11. The movement of air through the exhaust ports 10, the passageways 24 and the impeller 8 cause a continuous suction around the trimmer blades 2 thereby maximizing the effectiveness of the overall device.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A hand held hair trimmer comprising:

at least one reciprocating blade adapted to trim hair, a first electric motor coupled to the blade, an internal vacuum unit driven by a second electric motor, a trimmer body housing the electric motors and internal vacuum unit, a hair receptacle having a mechanism removably coupling the hair receptacle inside the trimmer body, an air intake coupled to the internal vacuum unit and positioned to provide reduced air pressure at the blade, the air intake having a entrance positioned adjacent the blade adapted to collect hair clippings cut by the blade and direct the clippings into the trimmer body along a passageway leading from the entrance.

2. The hair trimmer of claim 1, further comprising an internal battery, said internal battery adapted to energize said electric motors.

3. The hair trimmer of claim 1, wherein said at least one reciprocating blade is adapted to accept a trimmer guard, said trimmer guard designed to distance said at least one reciprocating blade from a cutting surface.

4. The hair trimmer of claim 1, wherein said internal vacuum unit includes an impeller positioned within a housing.

5. The hair trimmer of claim 1, including a filter unit and a filter medium that is porous allowing for the passage of air but retaining the clippings.

6. The hair trimmer of claim 1, wherein said hair receptacle is slidably removable from said trimmer.

7. The hair trimmer of claim 1, wherein said trimmer is powered by an external power source.

8. A hand held hair trimmer comprising:

cutting blades arranged to provide an elongated hair trimming edge for cutting hair by moving the hair trimmer in either direction along an axis generally perpendicular to the elongated hair trimming edge, a first electric motor coupled to at least one of the blades, a vacuum unit driven by a second electric motor, a trimmer body housing the electric motors and vacuum unit, a hair receptacle having a mechanism removably coupling the hair receptacle inside the trimmer body, an air intake coupled to the vacuum unit and positioned to provide reduced air pressure at the blades, the air intake having a entrance positioned adjacent the blades to collect hair clippings cut by the blades and direct the clippings into the trimmer body along a passageway leading from the entrance.

9. The hair trimmer of claim 8, further comprising an internal battery, said internal battery adapted to energize said motors.

10. The hair trimmer of claim 8, wherein said blades are adapted to accept a trimmer guard, said trimmer guard designed to distance said blades from a cutting surface.

11. The hair trimmer of claim 8, wherein said vacuum unit includes an impeller positioned within a housing.

12. The hair trimmer of claim 8, including a filter medium that is adapted to retain the hair clippings but allow the passage of air.

13. The hand held hair trimmer of claim 8 and further including at least one guide shaped to divert hair cut at an end of the elongated hair trimming edge into the air intake.

14. The hand held hair trimmer of claim 8 wherein the air intake is shaped to guide the reduced air pressure from the vacuum unit beyond the ends of the elongated hair trimming edge.

15. A hand held hair trimmer comprising:

at least one reciprocating blade adapted to trim hair;

at least one electric motor coupled to the blade;

an air intake duct having one end positioned adjacent to the blade, the air intake duct adapted to collect hair clippings created by the blade;

the air intake duct coupled to at least one passageway, the passageway adapted to direct the hair clippings from the air intake duct;

an internal vacuum unit driven by the at least one electric motor and having an impeller positioned within the passageway, the vacuum unit adapted to reduce air pressure in the air intake duct and a portion of the passageway between the air intake duct and the impeller;

a trimmer body housing the at least one electric motor and the internal vacuum unit;

a hair receptacle having a mechanism removably coupling the hair receptacle inside the trimmer body.

16. The hand held hair trimmer of claim 15, further comprising a battery positioned within the trimmer body, said battery adapted to energize the at least one electric motor.

17. The hand held hair trimmer of claim 15 wherein the blade is adapted to accept a trimmer guard, the trimmer guard adapted to limit the cutting depth of the blade.

18. The hand held hair trimmer of claim 15, including a filter medium that is adapted to retain the hair clippings but allow the passage of air.

19. The hand held hair trimmer of claim 15, wherein said hair receptacle is slidably removable from said trimmer.

20. The hand held hair trimmer of claim 15, wherein said trimmer is powered by an external power source.

* * * * *

US007076878C1

(12) EX PARTE REEXAMINATION CERTIFICATE (7067th)

United States Patent

Degregorio, Jr.

(10) Number: US 7,076,878 C1

(45) Certificate Issued: *Sep. 15, 2009

(54) BEARD TRIMMER WITH INTERNAL VACUUM

(76) Inventor: Dennis P. Degregorio, Jr., 15736 Terrace Dr., Oak Forest, IL (US) 60452

Reexamination Request:
No. 90/008,984, Jan. 8, 2008

Reexamination Certificate for:

| | |
|---|---|
| Patent No.: | **7,076,878** |
| Issued: | **Jul. 18, 2006** |
| Appl. No.: | **10/901,541** |
| Filed: | **Jul. 29, 2004** |

( * ) Notice: This patent is subject to a terminal disclaimer.

Related U.S. Application Data

(63) Continuation of application No. 10/075,647, filed on Feb. 14, 2002, now Pat. No. 6,978,547.

(60) Provisional application No. 60/268,732, filed on Feb. 14, 2001.

(51) Int. Cl.
*B26B 19/44* (2006.01)

(52) U.S. Cl. ..... 30/133; 30/41.6

(58) Field of Classification Search ..... None
See application file for complete search history.

(56) References Cited

U.S. PATENT DOCUMENTS

| | | | | |
|---|---|---|---|---|
| 2,716,279 A | | 8/1955 | Peterson | |
| 3,035,346 A | | 5/1962 | Campbell | |
| 4,314,405 A | * | 2/1982 | Park | 30/133 |
| 4,622,745 A | | 11/1986 | Wahl | |
| D294,407 S | | 2/1988 | Ullmann | |
| 4,776,095 A | | 10/1988 | Tsujimoto et al. | |
| 5,050,305 A | | 9/1991 | Baker et al. | |
| 5,084,974 A | | 2/1992 | Sukow et al. | |
| 6,684,511 B2 | * | 2/2004 | McCambridge et al. | 30/216 |
| 7,076,878 B2 | | 7/2006 | Degregorio, Jr. | |

FOREIGN PATENT DOCUMENTS

| | | |
|---|---|---|
| DE | 3112586 | 10/1982 |
| DE | 3330741 | 3/1985 |
| DE | 19508462 | 9/1995 |
| JP | H7-51472 | 2/1995 |
| JP | 8024447 | 1/1996 |

* cited by examiner

*Primary Examiner*—Glenn Dawson

(57) ABSTRACT

The invention is directed to a beard trimmer with an internal vacuum system that collects the hair clippings generated by the trimmer during grooming. The beard trimmer is comprised of two main mechanisms, a beard trimmer and a vacuum powered suction unit. The beard trimmer with internal vacuum is comprised of an external body, which houses a motor, wiring, and a power source. Additionally, the beard trimmer casing also houses the vacuum powered suction unit. The beard trimmer also includes of a pair of reciprocating cutting blades and an electric motor that drives the blades. The vacuum powered suction unit includes an air intake, a filter unit, a hamster cage or turbine style impeller, a filter unit housing, and at least one external exhaust port. The suction unit is designed to capture the clippings created by the blade during grooming. The resultant trimmer allows an operator to trim facial hair while simultaneously collecting hair clippings created by the trimming process.

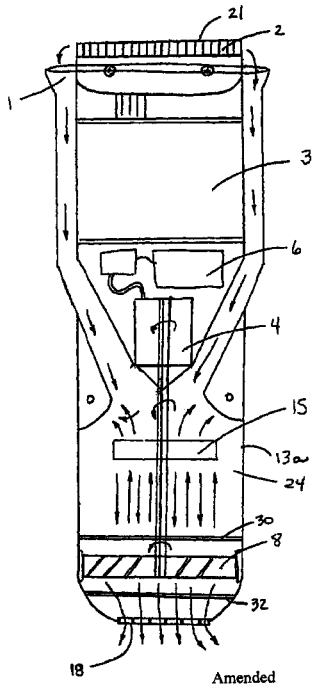

Amended

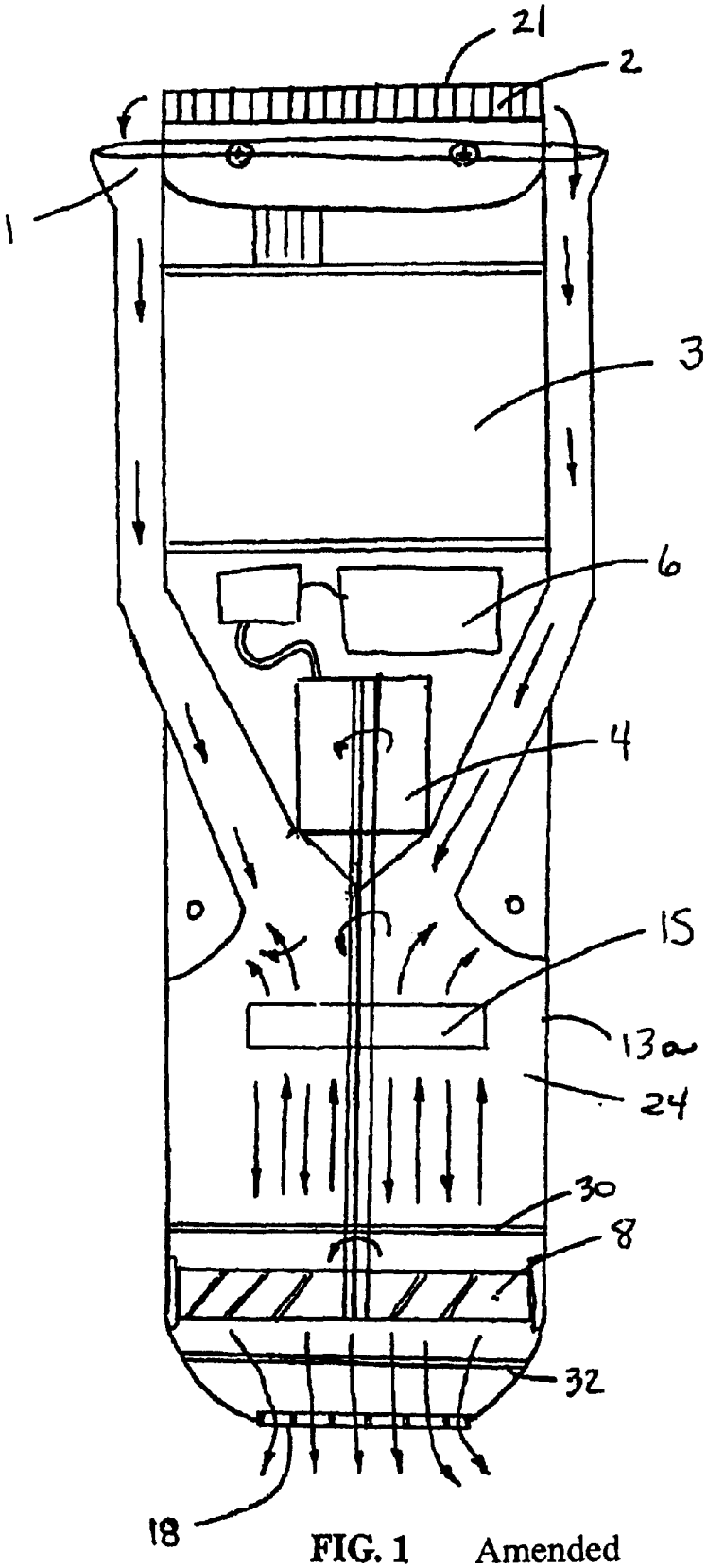
FIG. 1 Amended

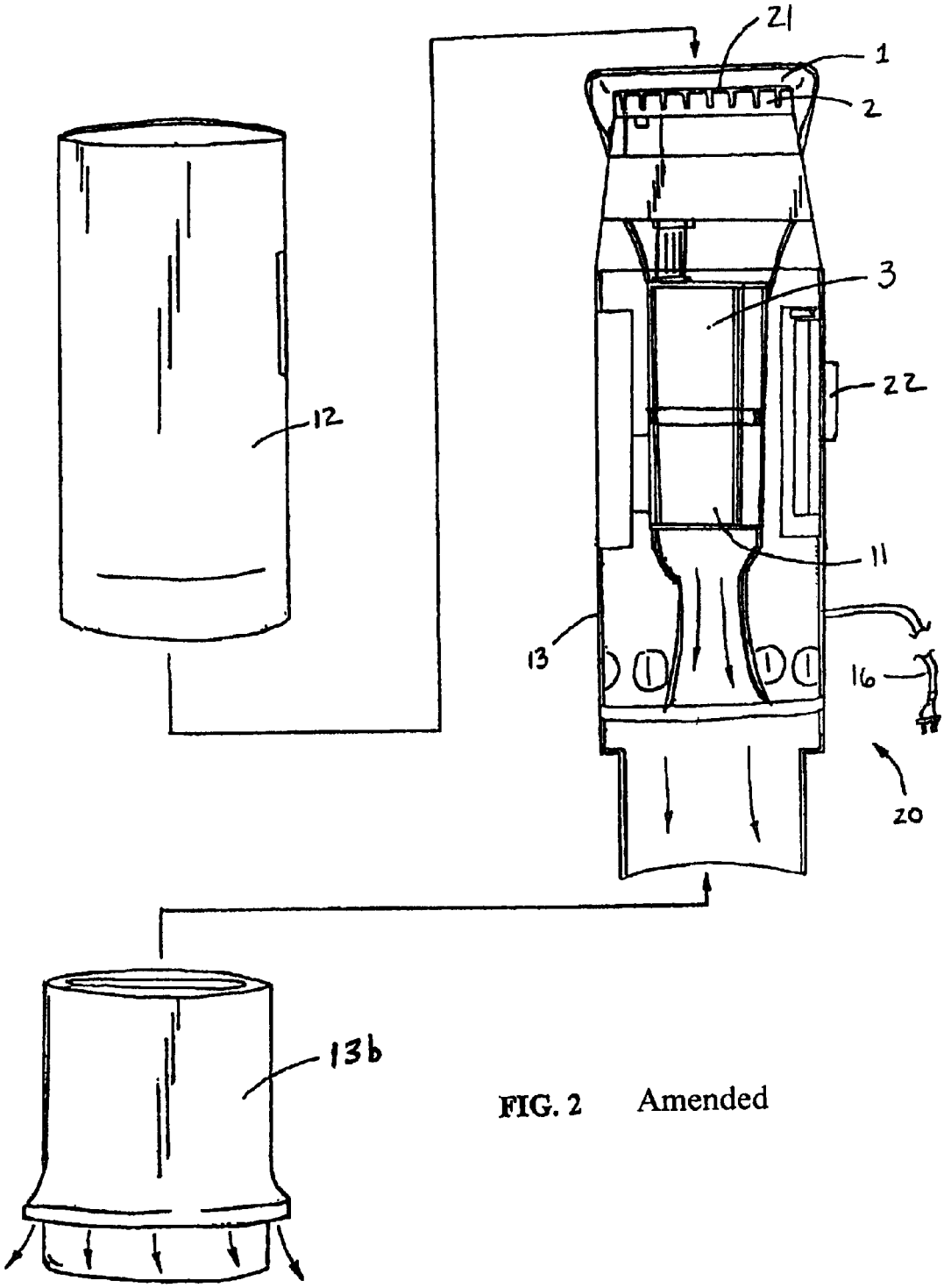
FIG. 2 Amended

Figure 4:
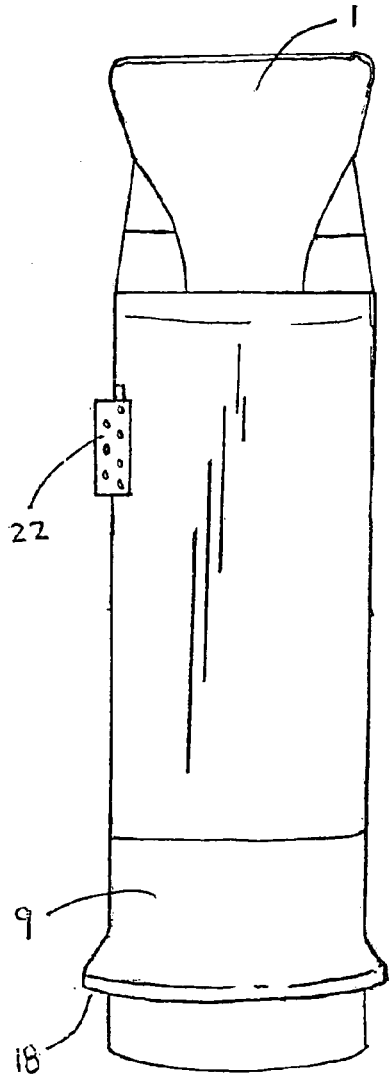
FIG. 4 is a front view of the trimmer blades and vacuum scoop.

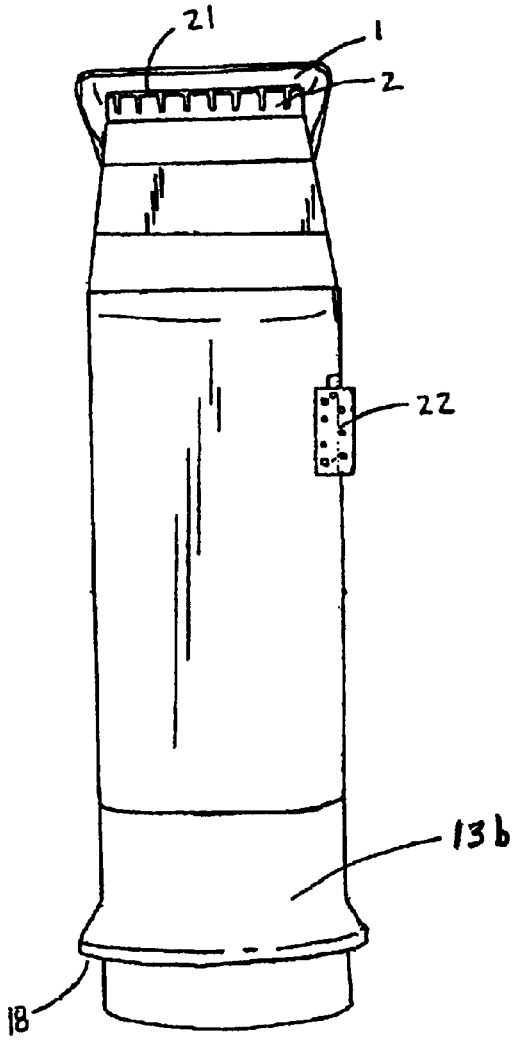
FIG. 3 Amended
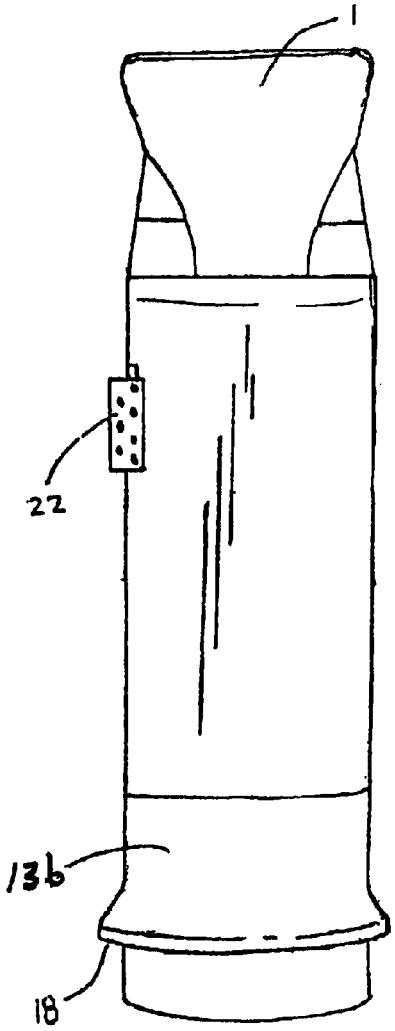
FIG. 4 Amended

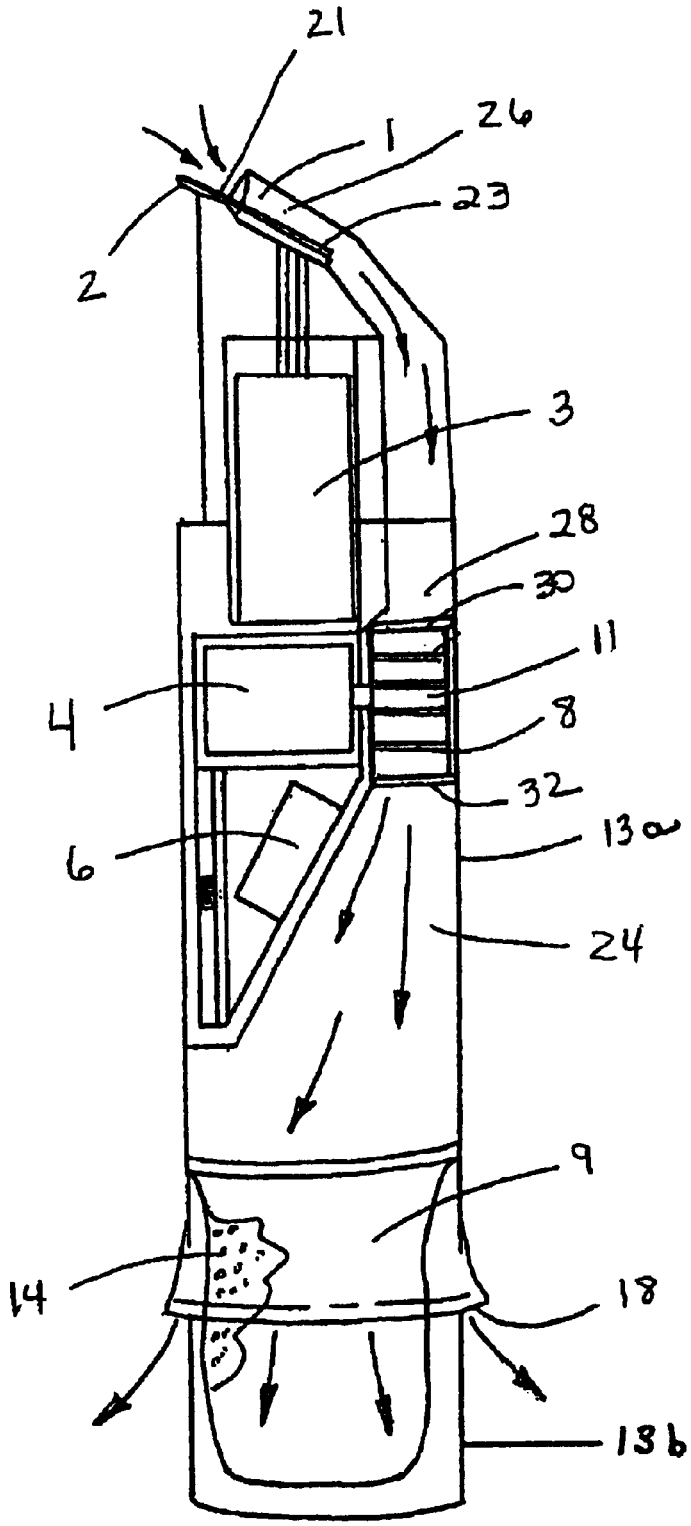
FIG. 5 Amended

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 6–19:

A beard trimmer 20 with internal vacuum 11 of the present invention is shown in FIGS. 2 and 5. The internal vacuum 11 is mounted in a beard trimmer body [13] *13a*, which is vibration resistant, durable, and lightweight. The beard trimmer 20 with internal vacuum 11 allows the user unaided cleanup of hair clippings left behind from cutting blades 2 of the beard trimmer 20. The beard trimmer 20 includes the trimmer body [13] *13a*, a filter bag housing [9] *13b* and a trimmer casing 12. The trimmer body [13] *13a*, houses the power switch 22, an electric motor 3 for reciprocating cutting blades 2 and the internal vacuum unit 11, which creates an internal suction within the trimmer body [13] *13a,*. The trimmer 20 further includes passageways 24 to direct clippings from the vacuum unit 11 to the filter bag 9.

Column 2, lines 20–26:

The internal vacuum unit 11, shown in FIG. 3, is integrated into the beard trimmer body [13] *13a* and has a scooped air intake 1 on the outside the casing 12 adjacent to the trimmer blades 2. The internal vacuum unit shown in FIG. 5 has an air intake 1, at least one motor 3, a power supply 6, *and* a cage or turbine style impeller 8[, ]. [a] *A* filter bag housing [9] *13b*, and at least one exhaust port 18 *are associated with the vacuum unit*.

Column 2, lines 27–45:

The trimmer assembly 20 shown in FIG. 5 of the preferred embodiment, uses the metal blades 2 to cut the facial hair. The trimmer blades 2 are in sliding contact with one another and are arranged to that the blades 2 extend towards the front 21 of the beard trimmer 20. The rear of the trimmer blades 23 is connected to the motor 3 and is attached to the trimmer body [13] *13a* so as to provide support for the blades 2 while also allowing lateral movement for cutting. The trimmer blades 2 are powered by the motor 3, which moves the trimmer blades 2 laterally with respect to each other. This lateral movement allows the trimmer blades 2 to uniformly shear facial hair. Additionally, the trimmer blades 2 are slidably adjustable with respect to the beard trimmer 20 allowing for variations in cutting depth. Blade guards (not shown) may also be placed on the trimmer blades 2 to adjust the cutting depth. While this is the preferred blade assembly, one who is reasonably skilled in the art may foresee that a rotary blade assembly may be used, wherein the blades operate in a clockwise or counter-clockwise direction.

Column 2, line 67 to Column 3, line 13:

The air intake 1 is mounted near of the cutting blades 2. This arrangement allows the clippings to be immediately directed into the air intake 1 upon cutting. The air intake 1 is of a ducted design that tapers into the bear trimmer body [13] *13a*. The air intake 1 is preferably fabricated out of plastic, however, one skilled in the art could fabricate the air intake 1 out of other materials including metal alloys, resins, or any other material of sufficient strength. The air intake is comprised of the mouth section 26 and the rear section 28. The mouth section 26 of the air intake 1 is slightly wider and higher than the trimmer blades 2, as shown in FIGS. 2–5, so that it covers the full range of movement of the blades 2 to catch the hair clippings discharged by the trimmer blades 2. The rear section 28 of the air intake 1 funnels the low-pressure air and clippings into the impeller 8.

Column 3, lines 28–38:

The motor 4 rotates the impeller 8 to generate the suction force required to create a negative pressure zone to direct the clippings into the vacuum intake 1 as shown in a second embodiment in FIG. 1. The suction generated by the impeller 8 propels the hair clippings from the intake 1 into the top member 30 of the impeller 8. Once in the impeller 8, a high-pressure zone is created, which propels the hairs through the set of blades 15, that further reduces the size of the hair clippings. The hairs are then propelled through passageway 24 that directs the hair clippings into the filter bag housing [9] *13b*.

Column 3, lines 39–48:

The vacuum passageway 24 connects the impeller 8 to the filter bag housing [9] *13b*. The passageway 24 is made of an erosion resistant material so that the coarse hair traveling through the passageway 24 do not erode the passageway 24. The filter bag 9 contains pores 14, shown in FIG. 5, which are large enough to allow for the passage of air but are small enough to prevent the hair clippings from escaping the trimmer 11. The pores 14 allow the pressurized air from vacuum passageway 24 to escape through the back of the unit.

Column 3, lines 49–58:

The filter bag housing [9] *13b* is preferably cylindrical in design. In a first embodiment, the filter bag [housing] 9 would include a filter medium that is made of a woven, unwoven or other porous plastic material sufficient to filter the exhaust air passing out of the trimmer body [13] *13a*. The filter bag [housing] 9 filter medium may also be made of paper fiber or other material that would allow for the passage of air and retain the cut particles. The filter bag housing [9] *13b* is removably attached to the trimmer body [13] *13a* by use of a pressure or threaded fitting, or by sliding.

Column 3, lines 59–66:

Surrounding the filter bag housing [9] *13b* are the exhaust ports 18. The exhaust ports 18 allow the high-pressure air to escape to the atmosphere, thereby creating a pressure zone inside the housing [9] *13b of* the beard trimmer with internal vacuum 11. The movement of air through the exhaust ports 10, the passageways 24 and the impeller 8 cause a continuous suction around the trimmer blades 2 thereby maximizing the effectiveness of the overall device.

THE DRAWING FIGURES HAVE BEEN CHANGED AS FOLLOWS:

In FIG. 1, "13" has been changed to -13a-, in FIGS. 2–4, "9" has been changed to -13b-; and in FIG. 5, "13" has been changed to -13a-, and -13b- has been added.

AS A RESULT OF REEXAMINATION, IT HAS BEEN DETERMINED THAT:

Claims 1–13 and 15–20 are cancelled.

Claim 14 was not reexamined.

* * * * *